United States Patent [19]

Scotoni

[11] 3,973,708

[45] Aug. 10, 1976

[54] SETTING TOOL CONTAINING A LAVAL NOZZLE

[75] Inventor: Ralph Scotoni, Triesen, Liechtenstein

[73] Assignee: Hilti Aktiengesellschaft, Liechtenstein

[22] Filed: Apr. 16, 1975

[21] Appl. No.: 568,385

[30] Foreign Application Priority Data

Apr. 25, 1974 Germany ..... 2420089

[52] U.S. Cl. ..... 227/10

[51] Int. Cl.[2] ..... B25C 1/14

[58] Field of Search ..... 227/8, 9, 10, 11

[56] References Cited

UNITED STATES PATENTS

| | | | |
|---|---|---|---|
| 3,554,424 | 1/1971 | Newton | 227/8 |
| 3,558,032 | 1/1971 | Oefinger | 227/8 |

*Primary Examiner*—Granville Y. Custer, Jr.
*Attorney, Agent, or Firm*—Toren, McGeady and Stanger

[57] ABSTRACT

In a setting tool using explosive caseless propellant charges for driving fastening elements into a hard target material, a combustion chamber for the charges is located rearwardly of the rear end of the bore in the setting tool through which a drive piston is displaceable for inserting the fastening elements. The combustion chamber is in communication with the rear end of the bore through at least one Laval nozzle. A mixing chamber can be located between the combustion chamber and the rear end of the bore with constant cross section flow channels located between the combustion chamber and the mixing chamber and with the Laval nozzle extending between the mixing chamber and the rear end of the bore. The rear end of the drive piston can be selectively positioned relative to the rear end of the bore so that a working chamber of variable dimension in the axial direction of the bore is provided between the rear end of the piston and the rear end of the bore.

11 Claims, 2 Drawing Figures

SETTING TOOL CONTAINING A LAVAL NOZZLE

SUMMARY OF THE INVENTION

The present invention is directed to a setting tool which uses explosive caseless propellant charges for driving fastening elements into a hard target material and, more particularly, it is directed to the arrangement of the rearward end of the bore in the setting tool which includes a combustion chamber for the caseless propellant charge located rearwardly of the rear end of the bore with one or more gas flow channels communicating between the combustion chamber and the rear end of the bore. Further, a drive piston is axially displaceable through the bore and its rearward position within the bore can be adjustably selected so that a working chamber or space is provided within the rear end of the bore.

The problem of a propellant charge not burning or burning only incompletely is a frequent occurrence in setting tools which use caseless propellant charges. In a caseless propellant charge the explosive powder is contained in a tablet-like form and it is not enclosed within a casing. Another problem of such caseless propellant charges is that they often explode with a time delay which has a negative effect.

The problems experienced with such charges can be counteracted if uniform pressure is maintained in the combustion chamber during the entire combustion period. It has been established that even slight pressure variations may lead to the disadvantages mentioned above.

Such setting tools in which the rear position of the drive piston is adjustable in the axial direction of the bore relative to the rear end of the bore for effecting performance control are particularly susceptible to the above problems. Depending on the rear position of the drive piston, the volume between the piston and the rear end of the bore varies for the expansion of the explosive gases and thus influences the pressure conditions.

It is the primary object of the present invention to provide a setting tool of the type described in which the pressure in the combustion chamber is not affected by external influences during the period of combustion of the propellant charge.

In accordance with the present invention, one or more Laval nozzles are provided between the combustion chamber and the rear end of the bore to prevent external influences from affecting the pressure within the combustion chamber during the combustion period.

As is known, the Laval nozzle serves for the generation of ultrasonic flows. The characteristic feature of the Laval nozzle is that its profile or transverse cross section in the direction of flow first narrows progressively and then expands. Upon the attainment of an ultrasonic flow, the pressure at the first end of the nozzle becomes independent of the pressure at the opposite end of the nozzle, that is, the end from which the flow exits. Therefore, a pressure variation in the working space into which the nozzle opens has no influence on the pressure within the combustion chamber. Consequently, the caseless propellant charge always burns under the same optimal pressure conditions. The most favorable dimensions of the Laval nozzle depend on the size of the combustion chamber and the force developed by the propellant charge.

For uniform combustion of the propellant charge, it is advantageous if at least two Laval nozzles are used. If, because propellant charges are used which are damp, one aperture is clogged by unburned particles of the propellant charge, no dangerously high pressures can develop in the combustion chamber, since the combustion or explosive gases can escape through the other gas flow channel or channels. In practice, it is advantageous if several Laval nozzles are used, since it is easier to optimize the tool design than with a single nozzle of larger cross section.

In most setting tools, the propellant charge is designated by a firing pin striking the center of the charge. However, to assure sufficient compression required for detonation of the charge, it is advantageous if the charge is supported on its surface opposite the firing pin. Accordingly, it is preferable to locate the Laval nozzle offset radially from the axis of the combustion chamber extending in the direction of the axis of the bore. Accordingly, a support surface can be provided on the bore side of the combustion chamber against which the propellant charge rests.

To assure that no unburned residues of the propellant charge reaches the working chamber at the rear end of the bore, it is advantageous to position a mixing chamber between the combustion chamber and the rear end of the bore. As a result, if some unburned particles of the propellant charge are carried along by the gas flow out of the combustion chamber, they can burn up completely in the mixing chamber. Further, the mixing chamber can also act as a pressure reservoir so that there is hardly any change in the combustion chamber pressure during the explosion of the propellant charge.

Where a mixing chamber is used it is expedient to locate the Laval nozzles between the mixing chamber and the working chamber at the rear end of the bore. In such an arrangement, the Laval nozzle can be disposed centrally of the bore axis to provide for a symmetrical distribution of the gas jet. The combustion chamber communicates directly with a gas expansion chamber whose size always remains the same so that constant conditions prevail for the combustion of the propellant charge. The pressure between the mixing chamber and the combustion chamber is equalized through the use of flow channels of constant cross section. Further, a mixing chamber is also helpful for the formation of the flow through the Laval nozzle. Laval nozzles of different cross sectional dimensions and shapes may be used for additional performance control. Accordingly, it is advantageous if the Laval nozzles are positioned in an exchangeable or replaceable insert. For a quick exchange of the individual nozzles, they may also be disposed in a drum shaped magazine supported on the setting tool. However, the use of exchangeable sleeves forming the nozzles is also possible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matters in which there are illustrated and described preferred embodiments of the invention.

DETAILED DESCRIPTION OF THE INVENTION

Figure 1:
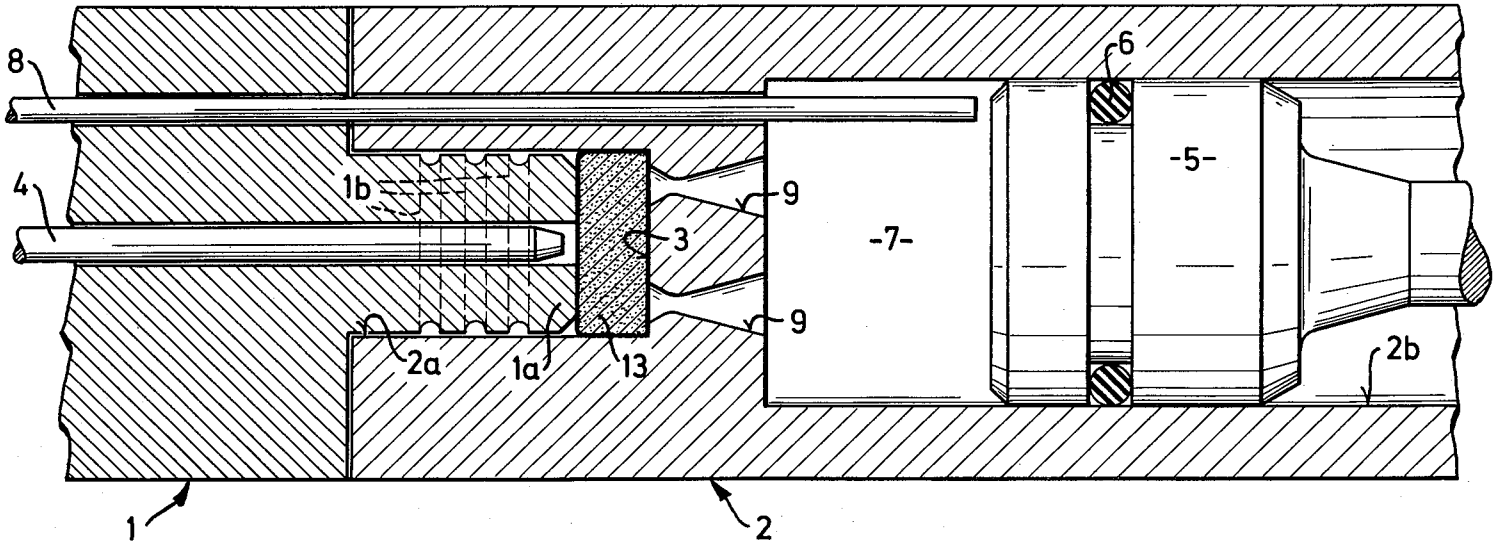
FIG. 1 is a partial axial sectional view through a fastening element setting tool embodying the present invention.

In FIG. 1 an axially extending portion of a fastening element setting tool or gun using a caseless propellant charge is illustrated and is formed of a member including a breech mechanism 1 and a barrel 2 forming an axially extending bore 2*b*. The portion of the bore illustrated is its rear end, the front end of the bore is not shown, that is the end from which fastening elements are driven into the target material. The barrel 2 extends rearwardly from the rear end of the bore 2*b* and forms a hole 2*a* into which a pin shaped portion 1*a* of the breech mechanism 1 projects. The axial length of the pin shaped portion 1*a* is less than the axial length of the hole 2*a* so that a combustion chamber 3 is formed within the hole between its bottom surface and the end of the pin shaped portion. A caseless propellant charge 13 is located within the combustion chamber 3. To provide an improved seal between the pin shaped portion 1*a* and the juxtaposed surfaces of the hole 2*a*, grooves 1*b* are positioned in the periphery of the pin shaped portion 1*a*. A firing pin 4 is positioned within the breech mechanism 1 so that it is axially displaceable into the combustion chamber for contacting the propellant charge. When the setting tool is fired, the firing pin strikes the propellant charge at its center.

Within the barrel 2 a drive piston 5 is axially displaceable through the bore 2*b* between a rearward position as shown in the drawings and a forward position which it assumes in driving a fastening element into the target material. A sealing ring 6 is provided in the outer periphery of the rear end of the drive piston. Extending through the breech mechanism 1 and the barrel 2 into the rear end of the bore 2*b* is a regulating rod 8 and the extent of its projection into the bore is selectively adjustable. The end of the rod determines the rearward position of the drive piston 5 and a working chamber or space 7 of variable axial dimension, in accordance with the extent of the projection of the rod 8 into the bore, is provided between the rear end of the bore and the rearward end of the piston. By adjusting the projection of the regulating rod 8 into the bore 2*b* it is possible to control the performance of the setting tool.

When a propellant charge is ignited, the explosive gases generated reach the working chamber 7 through gas flow channels which, according to the invention, are in the form of Laval nozzles 9. With the proper nozzle configuration and dimensions, an ultrasonic flow originates within the nozzle. As a consequence, the pressure within the combustion chamber 3 is not influenced by the pressure change within the working chamber 7. As shown in FIG. 1, the Laval nozzles 9 are offset from the central axis of the combustion chamber which is in general alignment with the axis of the bore 2*b*. This arrangement assures a support for the propellant charge 13 on the opposite side of the combustion chamber 3 from the position of the firing pin.

Figure 2:
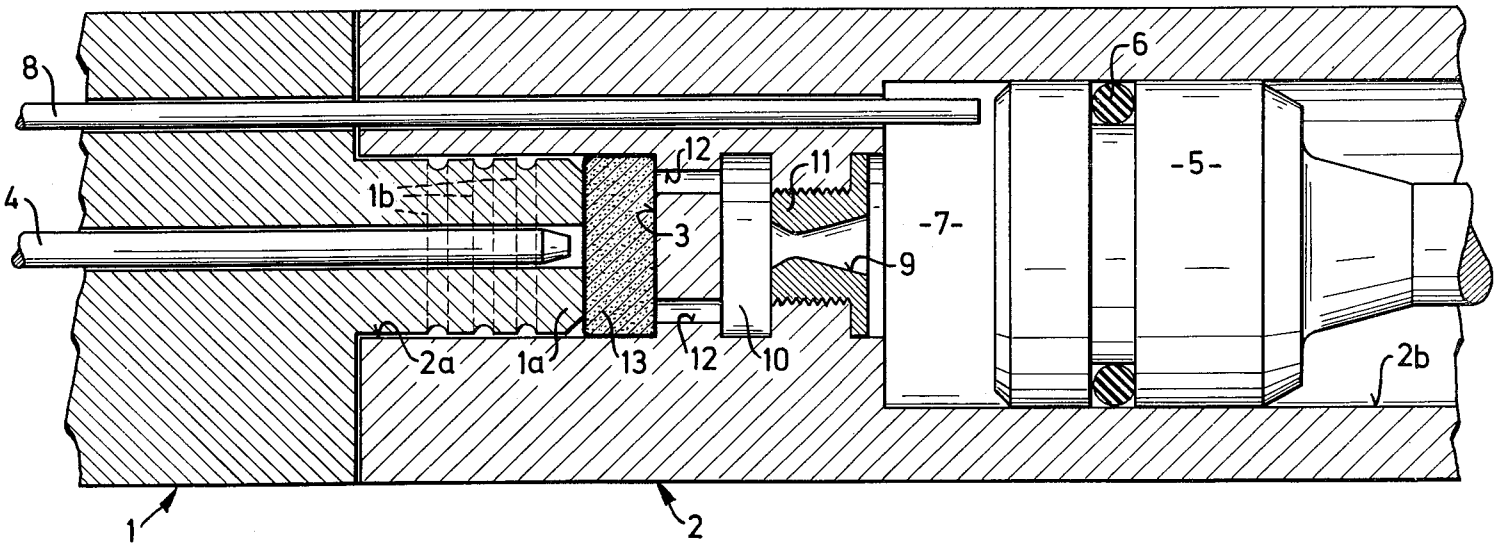
FIG. 2 is another partial axial sectional view, similar to FIG. 1, of another embodiment of a fastening element setting tool illustrating the present invention.

In FIG. 2 another embodiment of a setting tool incorporating the present invention is illustrated. The arrangement of this embodiment is similar to that shown in FIG. 1, however, in FIG. 2 a mixing chamber 10 is located within the rearward end of the barrel between the combustion chamber 3 and the working chamber 7 located at the rear end of the bore 2*b*. In this arrangement, the Laval nozzle is provided within an exchangeable insert 11 and is located between the mixing chamber 10 and the rear end of the bore 2*b*. Flow channels 12 of constant transverse cross section extend forwardly from the combustion chamber 3 into the mixing chamber 10. Any unburned parts of the propellant charge 3, carried by the explosive gas flow into the mixing chamber 10, can burn up completely within the mixing chamber before the gases flow through the Laval nozzles 9 into the working chamber 7. In this arrangement the Laval nozzle is aligned with the axis of the bore and of the combustion chamber, since the structure between the combustion chamber and the mixing chamber affords the requisite support for the propellant charge counteracting the firing pin. As in the arrangement shown in FIG. 1, the rearward position of the drive piston 5 relative to the rear end of the bore is controlled by the extent to which the rod 8 projects into the bore. Accordingly, the firing of the propellant charge 13 is regulated in the same general manner in the embodiments of FIGS. 1 and 2.

While specific embodiments of the invention have been shown and described in detail to illustrate the application of the inventive principles, it will be understood that the invention may be embodied otherwise without departing from such principles.

What is claimed is:

1. A setting tool employing an explosive caseless propellant charge for driving fastening elements into a hard target material, comprises a member forming an axially elongated bore having a rear end and a front end, said member forming a combustion chamber arranged to receive a caseless propellant charge and said combustion chamber located adjacent the rear end of said bore and on the opposite side of said rear end from the front end thereof, said member forming at least one gas flow channel communicating between said combustion chamber and the rear end of said bore, a drive piston movably displaceable through said bore from the rear end toward the front end thereof under the action of an exploded propellant charge and said drive piston being movably displaceable toward the rear end of the bore after the insertion of a fastening element, wherein the improvement comprises that said gas flow channel is a Laval nozzle, and an axially extending firing pin located within said member rearwardly of said combustion chamber for igniting a propellant charge therein.

2. A setting tool, as set forth in claim 1, wherein at least two said Laval nozzles are provided each arranged for flowing explosive gas from said combustion chamber to the rear end of said bore.

3. A setting tool, as set forth in claim 2, wherein the at least two said Laval nozzles are offset radially outwardly from the axis of said bore.

4. A setting tool, as set forth in claim 1, wherein said member forms a mixing chamber located between said combustion chamber and the rear end of said bore with flow channels communicating between said combustion chamber and said mixing chamber.

5. A setting tool, as set forth in claim 4, wherein said flow channels between said combustion chamber and said mixing chamber are of constant transverse cross section.

6. A setting tool, as set forth in claim 4, wherein said Laval nozzle extends between said mixing chamber and the rear end of said bore.

7. A setting tool, as set forth in claim 1, wherein said member comprises a replaceable insert and said Laval nozzle formed in said insert.

8. A setting tool, as set forth in claim 1, wherein means are positioned in said member for limiting the rearward position of said drive piston relative to the rear end of said bore so that an axially extending working chamber is formed therebetween.

9. A setting tool, as set forth in claim 8, wherein said means comprises a rod movably adjustable in the axial direction of said bore and extending into said bore for limiting the rearward position of said drive piston relative to the rearward end of said bore so that the axial dimension of said working chamber can be varied in accordance with the axial extent to which said rod extends into said bore.

10. A setting tool, as set forth in claim 1, wherein said combustion chamber being coaxial with the said bore, and said firing pin disposed in axial alignment with said combustion chamber and said member providing a bearing surface on the opposite side of said combustion chamber from said firing pin disposed transversely of the axis of said combustion chamber for forming a countersupport surface for the propellant charge within said combustion chamber when said firing pin is displaced against the propellant charge.

11. A setting tool, as set forth in claim 1, wherein said member comprises a barrel forming said bore and a breech member removably positionable in the end of said barrel adjacent the rearward end of said bore and said breech mechanism in combination with said barrel forming said combustion chamber.

* * * * *